US007802508B2

(12) United States Patent
Li

(10) Patent No.: US 7,802,508 B2
(45) Date of Patent: Sep. 28, 2010

(54) HIGH SPEED BRAIDER

(76) Inventor: Rijia Li, Jiamei Hardware Factory, Daluo Industrial Zone, Lecong Town, Shunde District, Foshan City, Guangdong Province 528315 P.R. (CN)

( * ) Notice: Subject to any disclaimer, the term of this patent is extended or adjusted under 35 U.S.C. 154(b) by 97 days.

(21) Appl. No.: 12/282,813

(22) PCT Filed: Feb. 8, 2007

(86) PCT No.: PCT/CN2007/000434

§ 371 (c)(1),
(2), (4) Date: Sep. 12, 2008

(87) PCT Pub. No.: WO2007/104224

PCT Pub. Date: Sep. 20, 2007

(65) Prior Publication Data

US 2009/0084251 A1 Apr. 2, 2009

(30) Foreign Application Priority Data

Mar. 14, 2006 (CN) ..... 2006 1 0058528

(51) Int. Cl.
*D04C 3/00* (2006.01)

(52) U.S. Cl. ..... 87/33

(58) Field of Classification Search ..... 87/33, 87/44

See application file for complete search history.

(56) References Cited

U.S. PATENT DOCUMENTS 3,892,161 A * 7/1975 Sokol ..... 87/29
4,034,643 A 7/1977 Iannucci et al. ..... 87/48
4,535,672 A * 8/1985 Bull et al. ..... 87/29
4,535,673 A * 8/1985 Winiasz ..... 87/29
4,535,674 A * 8/1985 Bull et al. ..... 87/29
4,535,675 A * 8/1985 Bull et al. ..... 87/29
4,620,473 A * 11/1986 Bull ..... 87/48

FOREIGN PATENT DOCUMENTS

| | | | |
|---|---|---|---|
| CH | 636146 | A | 5/1983 |
| CN | 2698824 | Y | 5/2005 |
| DE | 10231302 | A | 1/2004 |
| EP | 0726347 | A | 8/1996 |
| GB | 2167090 | A | 5/1986 |

* cited by examiner

*Primary Examiner*—Shaun R Hurley
(74) *Attorney, Agent, or Firm*—Morgan, Lewis & Bockius LLP

(57) ABSTRACT

A high speed braider, includes a main shaft, driven by a prime motor. The main shaft drives rotating shafts of inner and outboard spindle driving disks through a cylindrical gear transmission mechanism. The cylindrical gear transmission mechanism includes a main shaft gear and two translating gears. The main shaft gear engages with one of the cylindrical gears on the shaft of the inner or outboard spindle driving disks, and the two translating gears rotate together, of which, one engages with the cylindrical gear on the main shaft, another engages with the other of the cylindrical gears on the shafts of inner or outboard spindle disks. The transmission ratio between the rotating shaft of the inner spindle driving disk and the main shaft is equal to the transmission ratio between the rotating shaft of the outboard spindle driving disk and the main shaft.

4 Claims, 3 Drawing Sheets

HIGH SPEED BRAIDER

TECHNICAL FIELD OF THE INVENTION

The present invention relates to a device for cable manufacture, more particularly to a high speed braider for weaving a wire net layer onto the cable.

DESCRIPTION OF THE RELATED ART

High speed braiders for weaving a wire net layer onto a cable include a frame, a prime motor, inner and outboard spindle driving disks rotated by the prime motor and a plurality of inner spindle brackets and outboard spindle brackets both rotated by the inner and outboard spindle driving disks. When the high speed braider is under operation, the prime motor drives a main shaft, which in turn drives the inner and outboard spindle driving disks, then the inner and outboard spindle driving disks respectively drive the plurality of inner and outboard spindle brackets in opposite directions with a constant velocity. In known types of braiders, there are two main ways to drive the inner and outboard spindle driving disks by the main shaft. One is to provide bevel teeth on the periphery of the inner and outboard spindle driving disks, and the bevel teeth on the inner and outboard spindle driving disks synchronously engage with a bevel gear of the main shaft, so that the main shaft synchronously drives both of the inner and outboard spindle driving disks in opposite directions and with a constant velocity by said bevel gear. The disadvantage of this way is that the cost of processing such bevel teeth on the driving disks is too expensive, especially for large high speed braiders whose standard addendum circle diameter of the bevel teeth on the inner and outboard spindle driving disks is over 1 meter. In addition, the assembly of the bevel gear transmission is also difficult. Another way is described in Chinese utility model patent CN2698824Y (App. No: CN200420022546.9), titled "a transmission means of a braider", wherein the rotating shaft of the inner and outboard spindle driving disks are respectively provided with cylindrical gears, whose diameters are not equal. One is big and another is small. The two cylindrical gears respectively engage with two cylindrical gears of the main shaft, whose diameters are also not equal. Accordingly, one is small and another is big. When the main shaft rotates, the inner and outboard spindle driving disks are rotated in the same direction. In order for the inner and outbound spindle brackets to revolve in opposite directions with a constant velocity, the inner spindle bracket must have a rotation speed twice the rotation speed of the outboard spindle bracket. This makes the inner spindle driving disk drive the inner spindle bracket in a reverse direction via translating gears mounted between the inner spindle driving disk and the inner spindle bracket. Although the disadvantages of the bevel teeth transmission are overcome, the requirement of the assembly is increased because each bracket needs at least two translating gears. Especially when it comes to those large braiders having dozens of or even hundreds of brackets, the assembly is more difficult. On the other hand, the diameter of the translating gear is much smaller than the diameter of the inner spindle driving disk, so that the rotating speed of the translating gear is much faster than the speed of the inner spindle driving disk.

Thus, the translating gear wears out easily, so as to reduce the durability of the high speed braider.

SUMMARY OF THE INVENTION

The present invention is directed to solve the problems above-mentioned, and provides a high speed braider having better durability.

According to the present invention, there is provided a high speed braider comprising a frame, a prime motor, inner and outboard spindle driving disks rotated by the prime motor and a plurality of inner and outboard spindle brackets rotated by the inner and outboard spindle driving disks. A rotating shaft of the inner spindle driving disk is hollow and coaxially enclosed in a rotating shaft of the outboard spindle driving disk, so as to form a passage wherein cables can pass. The rotating shafts of the inner and outboard spindle driving disks are provided with cylindrical gears respectively, and are coupled to a main shaft, rotated by the prime motor, via a gear transmission mechanism. The gear transmission mechanism may be a cylindrical gear transmission mechanism. The gear transmission mechanism comprises a gear mounted on the main shaft and two translating gears. The gear of the main shaft directly engages with the cylindrical gear on one of the rotating shaft of the inner or outboard spindle driving disks. The two translating gears are coaxially arranged and rotate with each other. One of the translating gears directly engages with the gear of the main shaft. Another one directly engages with the cylindrical gear on the rotating shaft of the inner or outboard spindle driving disks which does not engage with the gear of the main shaft. The ratio of the number of teeth of all gears match the transmission ratio from the main shaft to the rotating shaft of the inner spindle driving disk which is equal to a transmission ratio from the main shaft to the rotating shaft of the outboard spindle driving disk. When the braider is under operation, the prime motor drives the main shaft to rotate, the cylindrical gear on the main shaft not only directly drives one rotating shaft of the inner or outboard spindle driving disk, but also drives another rotating shaft of the inner or outboard spindle driving disk by the two coaxial linkage translating gears, so that the rotating directions of the inner and outboard spindle driving disks are opposite. However, the rotating speeds thereof are the same due to the transmission ratios between the gears. Accordingly, the inner and outboard spindle driving disks rotate at the same speed in opposite directions. Hence, the bevel gear for transmission can be eliminated from the location between the inner and outboard spindle driving disks. In addition, the inner and outboard spindle driving disks can be rotated in opposite directions without a plurality of translating gears mounted between the inner spindle driving disk and the inner spindle bracket, thereby, the durability of the braider is enhanced.

The advantages of the present invention are: compared to a traditional bevel teeth braider, the bevel teeth on the inner and outboard spindle driving disks are removed, so as to reduce the cost of processing and difficulty of assembly. Compared to the high speed braider described in the Chinese utility model patent CN2698824Y (App. No: CN200420022546.9), the braider of the present invention eliminates the plurality of translating gears which wear easily. The durability of the braider is increased and the assembly is simplified. Furthermore, because there is no need for increasing the rotation speed of the inner spindle driving disk, it is good for improving the loads of the relating transmission components, and to make the operations of the transmission components of the inner and outboard spindle driving disks more reasonable. The above mentioned advantages may become more obvious when it comes to a large high speed braider. Finally, the arrangement of the two translating gears, which are coaxially arranged and rotate with each other, not only meets the transmission from the main shaft to the inner and outboard spindle driving disks, but also overcomes an interference problem of the locations of a plurality of gears. Hence, the braider of the present invention has a minimum number of the gears and a most compact structure.

BRIEF DESCRIPTION OF THE DRAWINGS

These and other aspects and advantages of the invention will become apparent and more readily appreciated from the following descriptions taken in conjunction with the drawings in which.

DETAILED DESCRIPTION OF EMBODIMENTS OF THE INVENTION

Figure 1:
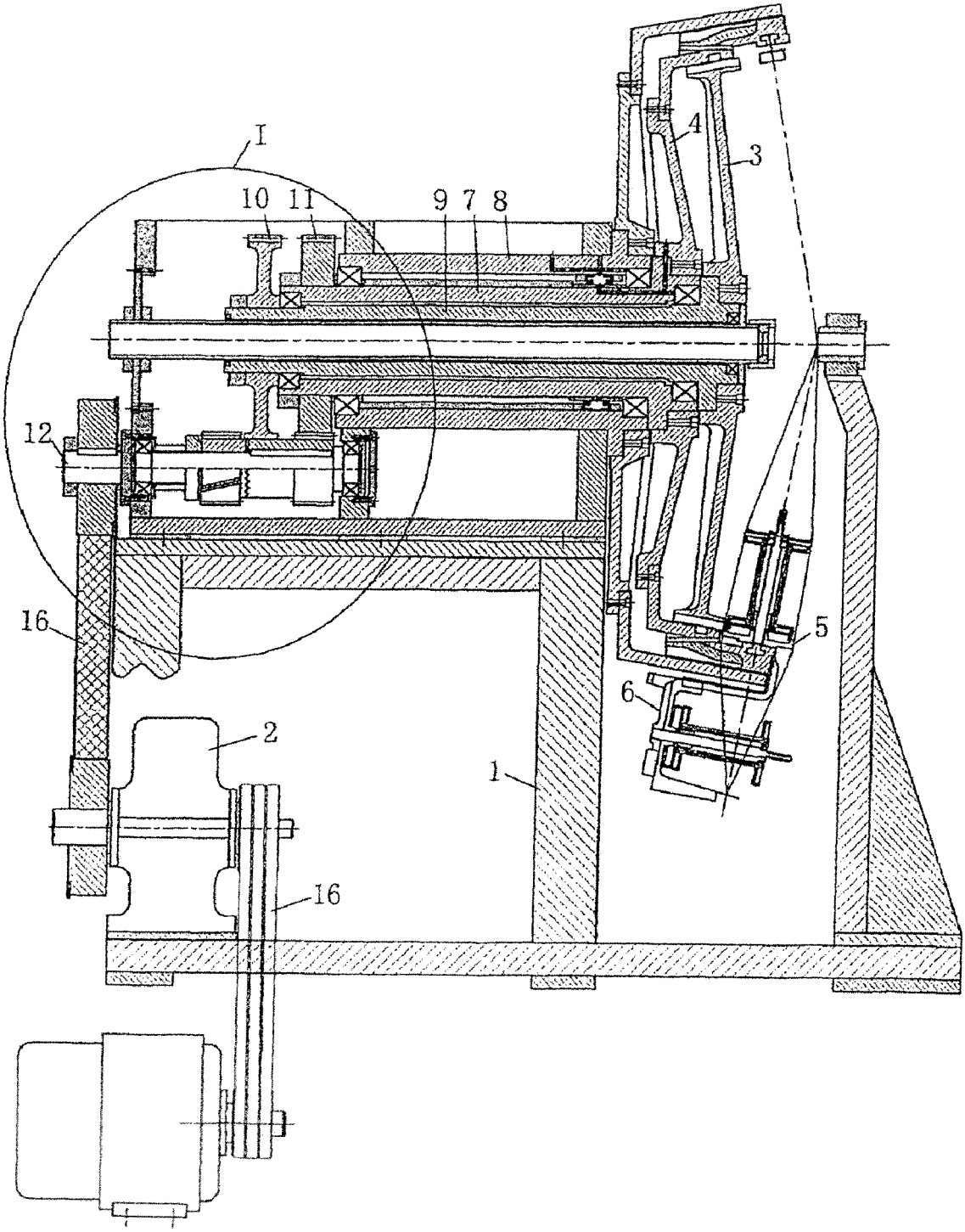
FIG. 1 is a schematic view of the overall structure of the high speed braider according to the present invention.

Referring to FIGS. 1 to 4, a high speed braider according to the present invention comprises a frame 1, a prime motor 2, an inner spindle driving disk 3 and an outboard spindle driving disk 4. The prime motor 2 is an electrical motor generally. The inner driving disk 3 and outboard spindle driving disk 4 respectively drive a plurality of inner spindle brackets 5 and outboard spindle brackets 6 to rotate with high speed (for a clear picture, there are only one inner spindle bracket and one outboard spindle bracket illustrated in FIG. 1). A rotating shaft 7 of the outboard spindle driving disk is enclosed in a hollow shaft sleeve 8 fixed onto said frame, and a rotating shaft 9 of the inner spindle driving disk is enclosed in the rotating shaft 7 of the outboard spindle driving disk. The rotating shaft 9 of the inner spindle driving disk is a hollow shaft, so as to form a passage wherein cables can pass. Cylindrical gears 10, 11 are respectively mounted on the ends of the rotating shafts 7, 9 of the inner and outboard spindle driving disks, and are coupled to a main shaft 12 by a cylindrical gear transmission mechanism. The cylindrical gear transmission mechanism includes a gear 13 mounted on the main shaft 12 and two translating gears 14, 15. The gear 13 directly engages with the cylindrical gear 10 on the rotating shaft of the inner spindle driving disk. The two translating gears 14, 15 are coaxially arranged and rotate with each other. One of the translating gears 14 directly engages with the gear 13 of the main shaft, another one of the translating gears 15 directly engages with the cylindrical gear 11 provided on the rotating shaft of the outboard spindle driving disk. The ratio of the number of teeth of all of the gears match the transmission ratio from the main shaft 12 to the rotating shaft 9 of the inner spindle driving disk which is equal to a transmission ratio from the main shaft 12 to the rotating shaft 7 of the outboard spindle driving disk. According to the above mentioned drawings, when the prime motor 2 drives the main shaft 12 with a belt 16, the main shaft 12 drives the inner and outboard spindle driving disks 3, 4 to rotate in opposite directions and with a uniform velocity by the gear transmission mechanism, so as to make the inner and outboard spindle brackets 5, 6 rotate in opposite directions and with a uniform velocity.

In another variety of the present invention, the gear 13 provided on the main shaft engages with the cylindrical gear 11 of the outboard spindle driving disk. Correspondingly, the translating gear 15 merely engages with the gear 13 of the main shaft, and another translating gear 14 merely engages with the cylindrical gear 10 of the inner spindle driving disk. The above mentioned motion effect can also be achieved by this structure.

Figure 2:
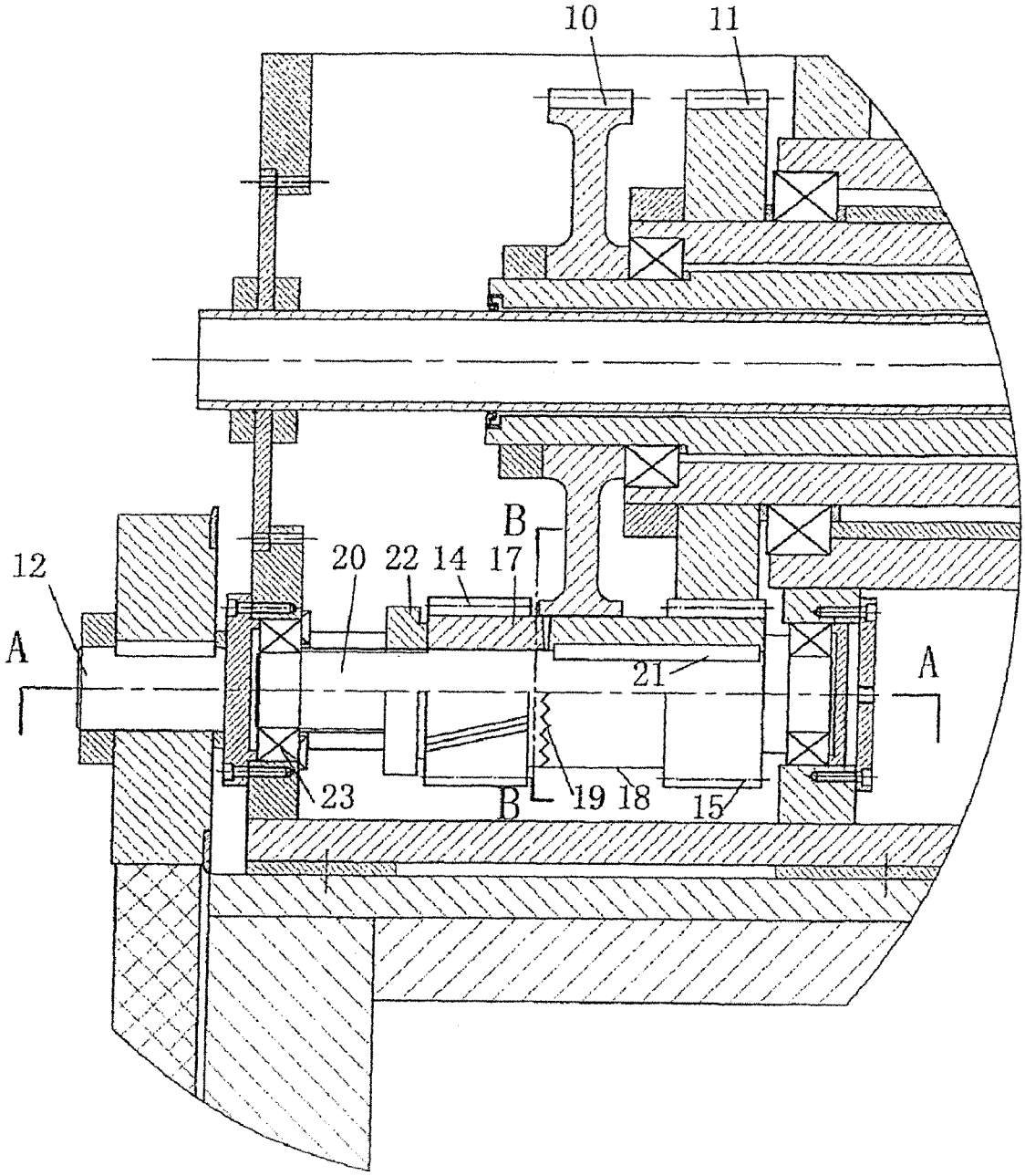
FIG. 2 is an enlarged view of part I in FIG. 1.
Figure 3:
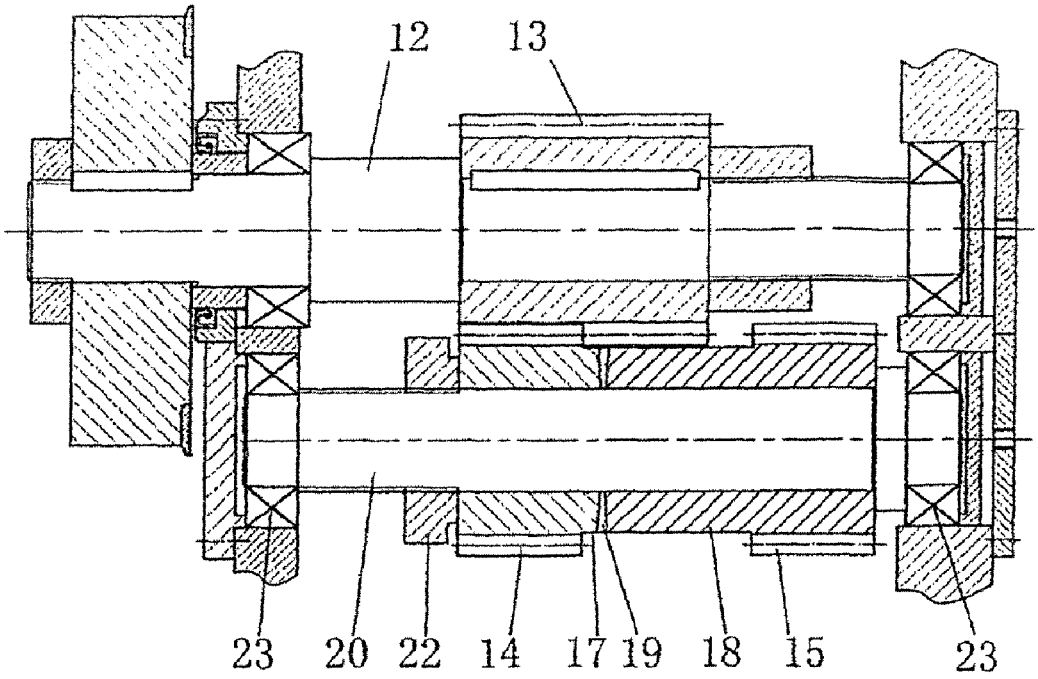
FIG. 3 is a sectional view along A-A in FIG. 2.
Figure 4:
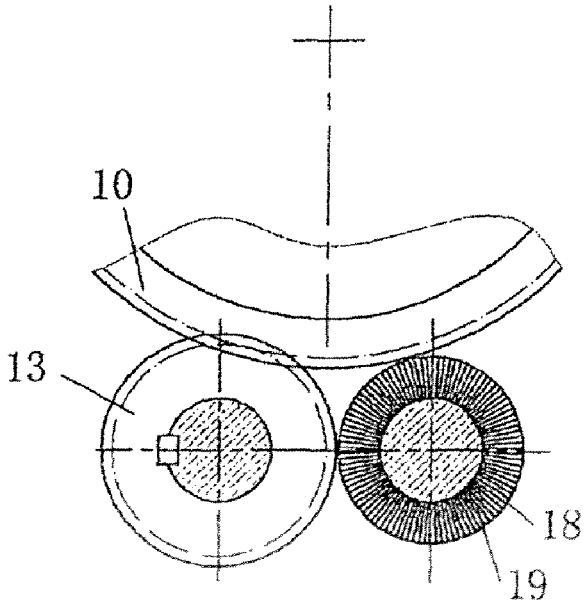
FIG. 4 is a sectional view along B-B in FIG. 2, wherein the translating gears 14 and rotating shaft 17 were removed, so that the FIG. 4 can clearly illustrate the engagements of gear 10 and gear 13 of the main shaft, and the structure of the terminal face teeth of the rotating shaft 18.

The definition of the above mentioned "the two translating gears are coaxially arranged and rotate with each other" is that the two translating gears 14, 15 are located on the same axis and transfer the torsion mutually, that means said two translating gears can be located on one shaft or respectively on two linkage shafts. We use the later. As shown in FIGS. 2 and 3, said two translating gears 14, 15 are respectively fixed on two rotating shafts 17, 18 which rotate with each other. This embodiment adopts the second option. As shown in the Figs, the two translating gears 14, 15 respectively are fixed on the two rotating shafts 17, 18 which are coupled by engagements of terminal face teeth 19 thereof, so that the two translating gears 14, 15 are coaxially arranged and rotate with each other. Both of the rotating shafts 17, 18 are hollow shafts and fit over a supporting shaft 20, wherein one rotating shaft 18 is fixed on the supporting shaft 20 by a key 21, another rotating shaft 17 freely rotates with respect to said supporting shaft 20 and is axially locked on said supporting shaft 20 by a nut 22 which is threaded to said supporting shaft. The supporting shaft 20 is coupled to the frame 1 by two ends bearings 23. The advantages of such coupling means for the two translating gears are that during installation or regulation for the high speed braider, an operator merely needs to loosen the nut 22 and separate the two hollow rotating shafts 17, 19, so that the rotating shafts of the inner or outboard spindle driving disks 9, 7 no longer rotate together. Then the inner or outboard spindle driving disks 3, 4 can be manually driven to adjust the corresponding phase relationship thereof. Secondly, this butt joint structure of the terminal face teeth allows for complete separation of the hollow shafts 17, 18 by a motion wherein the shaft 17 is only axially moved with a distance of one height of the terminal face tooth. Thirdly, the translating gear 14 can disengage with the gear 13 of the main shaft if the distance of the axial movement of the hollow shaft 17 is taken further, which allows for convenient adjusting and assembling of the gears. Conventional coupling ways for the connections of the two translating gears 14, 15 and the two hollow rotating shafts 17, 18, such as a key coupling and an interference fit may be adopted. However, in the preferred embodiment of the present invention, respectively, the two translating gears 14, 15 and the two hollow rotating shafts 17, 18 are integrally formed, and the two hollow rotating shafts 17, 18 respectively form gear necks of the two translating gears 14, 15. Therefore, it not only simplifies the structure of the braider, but it also enhances the assembly accuracy.

The minimum relative rotating angle for regulation between the inner spindle driving disk 3 and outboard spindle driving disk 4 is restricted not only by the tooth space of the terminal face teeth 19, but also by the engagement of the translating gear 14 and the gear 13 of the main shaft. Hence, in order to obtain as many optional regulating angles as possible, either the number of teeth of the translating gear 14 engaging with the gear of the main shaft or the terminal face teeth 19 of the hollow rotating shaft is even, and the number of teeth of another one is odd. In the regulation process, the relative rotating angle between the two hollow rotating shafts 17, 18 and the rotating angle of the translating gear 14 relative to the gear 13 of the main shaft, i.e. the tooth spacing angle of the translating gear 14 multiplies the number of the rotated teeth, are less repeated, so as to increase the number of optional rotating angles for regulation between the inner spindle driving disk 3 and outboard spindle driving disk 4. Furthermore, in a preferred embodiment the number of the teeth of said translating gear 14 engaging with the gear of said main shaft and the number of the teeth of said terminal face teeth 19 are relatively prime, i.e. 1 is the only common divisor thereof. Under this condition, the rotating angle of the translating gear 14 relative to the gear 13 of the main shaft are not equal to the relative rotating angle between the two hollow rotating shafts 17, 18, from rotating by one tooth to rotating by n−1 tooth (n=the number of the gear 14's teeth), so that there is a maximum number of optional regulating angles between the inner spindle driving disk 3 and outboard spindle driving disk 4. The number of the terminal face teeth of the two hollow rotating shafts 17, 18 are preferably equal. If the numbers thereof are not equal, it means one of the terminal face has more teeth, when it comes to the number of the terminal face teeth described in hereinbefore.

Although explanatory embodiments have been shown and described, it would be appreciated by those skilled in the art that changes, alternatives, and modifications can be made in the embodiments without departing from the spirit and principles of the invention. For instance, the cylindrical gear can be a straight-tooth or a helical gear; the gear on the main shaft can be divided into two, one engages with the cylindrical gear of the inner spindle driving disk, another engages with the translating gear; the number of teeth of the two translating gears may be unequal, but it must meet the transmission ratio relationship described in hereinbefore etc. Such changes, alternatives, and modifications all fall into the scope of the claims and their equivalents.

What is claimed is:

1. A high speed braider, comprising a frame;

a prime motor;

inner and outboard spindle driving disks, rotated by said prime motor; and a plurality of inner and outboard spindle brackets, rotated by said inner and outboard spindle driving disks;

a rotating shaft of said inner spindle driving disk, the rotating shaft of said inner spindle driving disk is a hollow shaft, and is coaxially enclosed in a rotating shaft of said outboard spindle driving disk, so as to form a passage wherein cables can pass, said rotating shafts of said inner and outboard spindle driving disks respectively having cylindrical gears, and are coupled to a main shaft, rotated by said prime motor, by a gear transmission mechanism, wherein said gear transmission mechanism is a cylindrical gear transmission mechanism comprising a gear mounted on said main shaft and two translating gears, said gear mounted on said main shaft directly engages the cylindrical gear provided on one of the rotating shaft of said inner or outboard spindle driving disks, said two translating gears are coaxially arranged and rotate with each other, one of said translating gears directly engages the gear of said main shaft, another directly engages the cylindrical gear on the rotating shaft of said inner or outboard spindle driving disks which is not engaged with the gear of said main shaft, ratios of the number of teeth of all gears match a transmission ratio from the main shaft to the rotating shaft of the inner spindle driving disk which is equal to a transmission ratio from the main shaft to the rotating shaft of the outboard spindle driving disk, and said two translating gears are fixed on two rotating shafts which are coupled together by terminal face teeth thereof so that said two translating gears are coaxially arranged and rotate with each other, both of said two rotating shafts of said translating gears are hollow inside and fitted over a supporting shaft, coupled to said frame by bearings, wherein one rotating shaft is fixed on the supporting shaft by a key, another rotating shaft freely rotates with respect to said supporting shaft and is axially locked on said supporting shaft by a nut, said nut threaded to said supporting shaft.

2. A high speed braider of claim 1, wherein said two translating gears and the corresponding hollow rotating shafts respectively are formed integrally, said hollow rotating shafts formed as gear necks of said translating gears.

3. A high speed braider of claim 1, wherein either the number of teeth of said translating gear engaging with the gear of said main shaft or of said terminal face teeth is even, and the number of teeth of the other is odd.

4. A high speed braider of claim 1 or 3, wherein the number of the teeth of said translating gear engaging with the gear of said main shaft and the number of the teeth of said terminal face teeth are relatively prime.

* * * * *